US005486272A

United States Patent [19]

Hemsley et al.

[11] Patent Number: 5,486,272

[45] Date of Patent: Jan. 23, 1996

[54] ELECTROPLATING METHOD AND APPARATUS

[75] Inventors: John D. C. Hemsley, Old Woking; Albert W. Gale, Yateley; Adrian Schwalb, Crowthorne, all of Great Britain

[73] Assignee: Enthone-Omi Inc., West Haven, Conn.

[21] Appl. No.: 251,152

[22] Filed: May 31, 1994

[30] Foreign Application Priority Data

May 28, 1993 [GB] United Kingdom ..... 9311055
Aug. 5, 1993 [GB] United Kingdom ..... 9316215

[51] Int. Cl.[6] ..... C25C 1/00

[52] U.S. Cl. ..... 204/105 R; 204/272; 204/275

[58] Field of Search ..... 204/272, 225, 204/105 R, DIG. 13; 205/151

[56] References Cited

U.S. PATENT DOCUMENTS

| | | | |
|---|---|---|---|
| 3,620,813 | 11/1971 | Minbiole et al. | 117/94 |
| 3,664,354 | 5/1972 | Minbiole et al. | 134/61 |
| 3,704,685 | 12/1972 | Neumann et al. | 118/6 |
| 3,782,791 | 1/1974 | Neumann et al. | 308/9 |
| 3,941,677 | 3/1976 | Bourne | 204/272 |
| 3,951,774 | 4/1976 | Jones | 204/272 |
| 3,957,599 | 5/1976 | Lindsay et al. | 204/105 |
| 4,149,954 | 4/1979 | Ransbottom | 204/272 |
| 4,357,225 | 11/1982 | Arita et al. | 204/281 |
| 4,654,137 | 3/1987 | Vaughan | 204/301 |

FOREIGN PATENT DOCUMENTS

| | | | |
|---|---|---|---|
| 1423369 | 2/1976 | United Kingdom | C25B 15/00 |
| 2057502 | 11/1982 | United Kingdom | C25B 11/02 |
| 9214865 | 9/1992 | WIPO | C25C 1/00 |

OTHER PUBLICATIONS

Derwent Abstract of SU 1082866to AS Belo Nuclear POW (Mar. 1984).

*Primary Examiner*—John Niebling
*Assistant Examiner*—Brendan Mee
*Attorney, Agent, or Firm*—Richard P. Mueller

[57] ABSTRACT

A method of removing metal from a feedstock solution containing dissolved metal ions which comprises passing the feedstock through an annular gap, the inner surface of which is cathodic to the metal ion and the outer surface of which is anodic in such a way that the flow is turbulent.

Also claimed is an apparatus for removing metal from a feedstock which comprises a reactor afforded by an inner cathode tube, and an outer anode tube spaced therefrom by a narrow annular gap, direct electric current supply means to the anode and cathode, pump means for pumping feedstock into the said annular gap at high flow rates, a holding tank, pipe work connecting the holding tank to the said pump means and the pipe work connecting the end of the annular gap remote from the pump to the holding tank.

13 Claims, 4 Drawing Sheets

ELECTROPLATING METHOD AND APPARATUS

Figure 1:
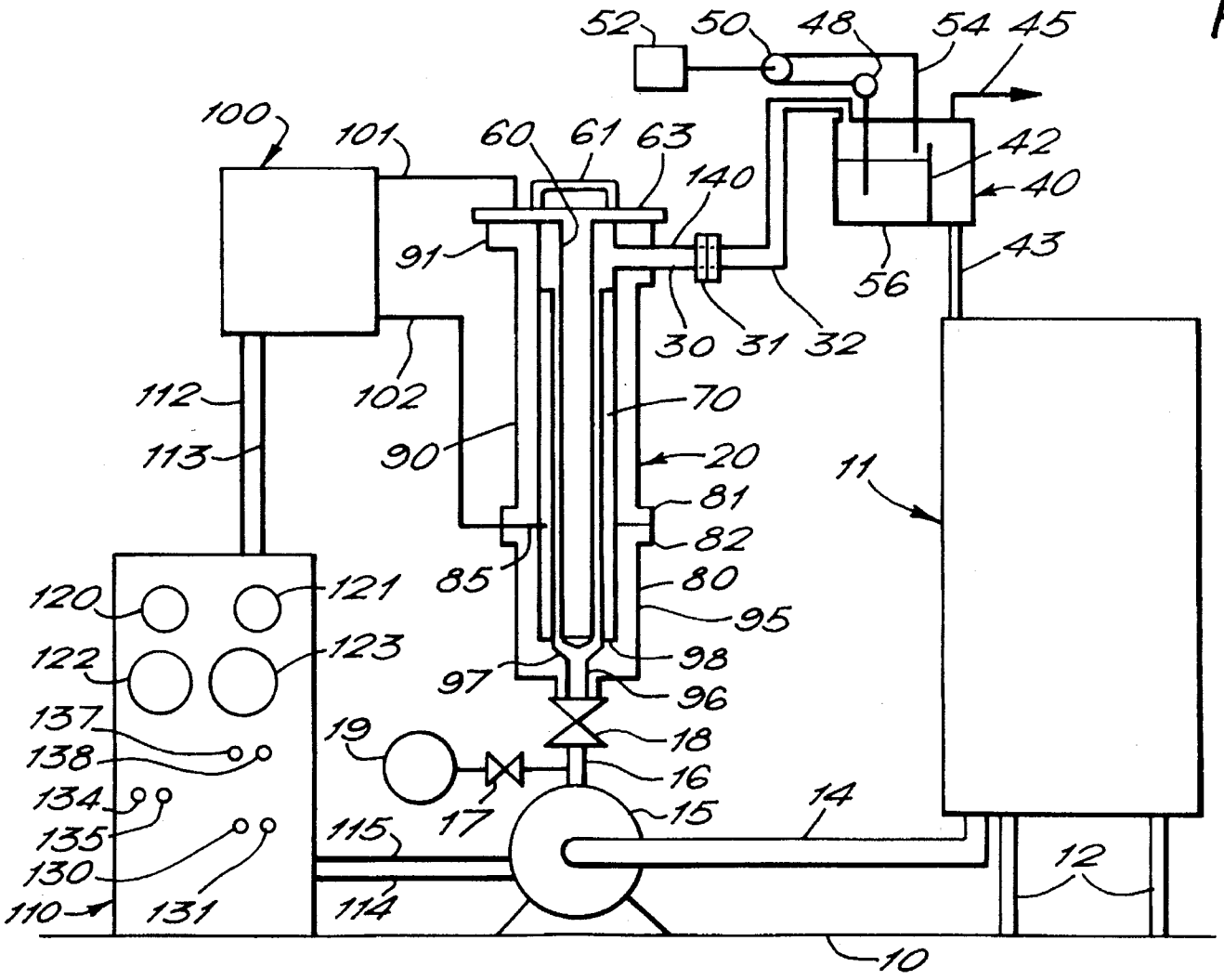

The present invention relates to recovery of metals in metallic form from solutions of their salts. Such processes are often referred to as "electrowinning" processes. They have been used to recover metals from ores as by treatment of leach solutions from ore dumps. They have also been used to reduce metal ion content in waste water from chemical processes and from industrial processes such as electroplating and, recently, printed circuit board manufacture, and from toxic metal solutions.

The invention will be described with particular reference to removal of metal ions such as copper from effluent from electroplating processes.

One such prior art process which has found considerable market acceptance in the UK is that disclosed in GB 1423369. This passes the feedstock effluent through an open topped tank containing flat or curved rigid plane anodes of materials such as platinum coated titanium mesh and cathodes of similar material or stainless steel plate in the presence of small nonconductive beads typically 0.5 to 2 mm in diameter. These are described as forming a fluidized bed. A metal foil is deposited on the cathode surfaces. When the cathode is stainless steel plate there is a tendency for the metal foil to peel away at the edges, contact a neighbouring anode and short circuit the system. This effect can be reduced in frequency by careful roughening of the cathode surfaces by the operator before each deposit cycle.

The beads also tend to escape from the bath and flow rates have to be kept below certain limits to stop this happening.

The system being open allows escape of any oxygen hydrogen or chlorine generated by the electrolysis into the atmosphere.

GB 1423369 refers to limits on current density due to the limiting effect of the rate of diffusion of ions through the boundary layer. It also states that "it has been proposed to use a fast flow of electrolyte through the cell to break up the boundary layer". It also mentions the use of rotating electrodes and as a third approach forming the cathode as a fluidized bed of conducting material.

It also states that higher current efficiencies were obtained using its system which were "far greater than has been obtained at similar concentrations using cells with fast flowing electrolyte . . . ". It does not state what it means by fast flowing. GB 1423369 was published on Feb. 4, 1976 and this prejudice has persisted to 1993 since the process of GB 1423369 has substantially the whole of the UK market.

According to the present invention a method of removing metal from a solution containing dissolved metal ions (hereafter the feedstock) comprises passing the feedstock through an annular gap, the inner surface of which is cathodic to the metal ion and the outer surface of which is anodic in such a way that the flow is turbulent, and preferably highly turbulent. Conveniently the anode and cathode are concentric tubes with the gap between them, e.g. coaxial cylindrical tubes.

This overcame the peeling problem, a smooth cylinder of pure fine grain metal being deposited.

Indeed rather than having to roughen the cathode surface it was found that it could advantageously be polished to facilitate release.

Release was also facilitated by locating one or more non-conductive strips along the cathode from which the deposited metal layer could be peeled. The best arrangement has been found to be when the strip is of a thickness essentially the same as the spacing between the cathode and the anode. Such a release strip preferably extends the full length of the cathode, e.g. parallel to its axis. It need not be wide, a few mm, e.g. 3–5 mm being sufficient. More than one such spacer can be used, e.g. 2, 3 or 4 or more preferably evenly spaced around the circumference. The strip can if desired merely be used for a deposit release function and removable nibs or screws insertable into the cathode surface, e.g. three evenly spaced around the circumference, e.g. at one but preferably at both ends have been used. Such an array with one release strip has been effective but the down time is lengthened because such nibs have to be removed before the deposit can easily be peeled off. The best array is thought likely to be three strips, e.g. of polyvinyl chloride, evenly spaced around the circumference and extending the full length of the cathode and desirably extending across the annular gap between cathode and anode so as to maintain the desired gap. Maintaining an even thickness of gap around the whole circumference and for the full length is highly desirable because it enables thicker deposits to be built up in a single run.

This arrangement enables high flow rates to be achieved without the need for excessively powerful pumps and Reynolds numbers in the turbulent flow region to be readily achieved.

The Reynolds number (Re) as used herein is $$\mathrm{Re} = \frac{dh \times U \times \mathrm{rho}}{\mathrm{mu}}$$

which is dimensionless group used for the characterisation of hydraulic flow, where dh is the hydraulic diameter calculated as:

dh=4×cross-sectional area/wetted perimeter, U is the linear velocity derived from the flow rate divided by the cross-sectional area. rho (P) is the density of the liquid and mu (μ) is the viscosity of the liquid.

We have used Re values of the order of 35,000 or more, namely a 5 mm gap extending out from a surface of 89 mm diameter, a flow rate of 12,000 liters per hour and aqueous electrolyte solutions of densities substantially that of water. i.e. 1 g/cc and viscosities substantially that of water, i.e. 0.7 centipoise at 40° C.

The cathodes are typically made of a size which can be handled by one man but are otherwise as large as possible. The cathode is typically 1140 mms long. The anode is typically about 4 feet (1000 mms) long. The circumference of the cathode is 279 mm and thus the active cathode area is 279000 sq mm, i.e. about 28 decimeters$^2$. The volume (V) in liters of liquid in the gap is calculated from the equation:

$$V = \frac{\pi}{4}\,(D_2^2 - D_1^2) \times 1000/10_6$$

where $D_2$ and $D_1$ are dimensions in mm. When $D_1$ is 89 mm and the gap is 5 mm $D_2$ is 99 mm. With a 2.5 mm gap and a cathode diameter of 89 mm the volume of liquid bounded by the electrodes at any one time is thus 718×1000 or 718000 cu. mm (i.e. 0.7 Liter). With a 5 mm gap the volume of liquid bounded by the electrodes at any one time is thus 1477×1000 cu. mm (1.5 liters). The active cathode surface is that which is opposite the anode surface and between which the gap is formed.

The ratio of active cathode surface area in sq. decimeters to reactor volume in liters is thus 19:1 for a 5 mm gap or 32:1 for a 3 mm gap. More broadly the ratio is preferably in the range 100:1 to 5:1, e.g. 80:1 to 15:1 or more preferably 50:1 to 20:1. At gaps much larger than this flow will no longer be turbulent and the volume of liquid has increased significantly.

The flow rate and cross-section of the annular gap are preferably such that the Re value of the flow is at least 2100, preferably at least 10,000, or at least 20,000 e.g. at least 35,000, more preferably at least 55,000 and especially preferably one hundred thousand (100,000) or more.

The inner surface may be the same as the metal ion in the feedstock or more preferably may be an inert metal. For example when the metal being recovered is copper the inner surface or cathode can be afforded by a stainless steel tube, or mild steel or titanium. This is preferably smooth and may be polished to a satin or even a bright or mirror finish.

The outer surface of the duct is the anode. This is also preferably smooth, e.g. machined smooth. It may be provided by a graphite tube desirably backed by a liquid impervious outer polymer, e.g. polypropylene, housing. The anode may be made of any material which is not attacked by the solution being processed and thus for certain feed stocks could be mild steel or stainless steel.

Other materials which can be used for the anode include titanium coated with iridium or platinum or ruthenium oxide. Lead can also be used.

The tubes are preferably cylindrical because this results in an even current density distribution and thus smooth fine grained deposits with reduced tendency to dendritic growth and thus resultant short circuits. However if such problems can be overcome there is no reason why the tubes may not be of different cross-section, e.g. oval or even rectilinear, e.g. square or hexagonal, though at the corners one might fear that deposit thicknesses would increase.

The objectives to be obtained are to have a constant gap width, high rates of turbulent flow and even fine grained deposits; these can readily be obtained with a cylindrical array which is thus much preferred.

The flow is preferably induced by a pump coupled directly to one end of the tubular array. The pump is preferably a centrifugal pump able to operate continuously for long periods of time so as to recirculate the feedstock continuously between a holding tank such as an in-line drag-out tank in an electroplating plant and the tubular reactor array. Periodically the cathode is removed to recover deposited metal.

The end of the inner cathode tube is preferably closed by a non-conductive plug, e.g. of polypropylene presenting a conical or preferably rounded conical end to the inflowing feed stock and distributing it evenly to the annular gap.

The outlet from the pump is preferably aligned with the end of the inner cathode tube work. Preferably, it is axially aligned, although any other arrangement which delivers the electrolyte evenly to the annular gap can be used.

When the pump outlet is a single opening coaxial with the cathode tube it feeds a conical annular slot formed between the plug in the end of the cathode tube and a dividing conical wall extending from the region of the outer wall of the annular gap (the line wall of the anode). This conical wall is preferably straight in sections but could be curved.

The slot is however preferably always wider than the annual gap.

The angle of the conical wall to the longitudinal axis of the pump outlet is preferably in the range 30° to 60°. This enables the base of the tubular array to be as short as possible.

The invention also extends to a method in which the cathode is provided with one or more non-conductive regions extending along some or all of its length such that metal deposited on the cathode has a weakness region formed in it at the said non-conductive regions such as to facilitate removal of the deposited metal as foil or sheet from the cathode surface. Preferably at least one such non-conductive regions extends the full length of the cathode surface, desirably parallel to the longitudinal axis.

The invention also extends to a reactor for removing metal from a feedstock as defined herein which comprises an inner cathode tube, an outer anode tube spaced therefrom by a narrow annular gap, electric current supply means to the anode and cathode, pump means for pumping feedstock into the said annular gap at high flow rates, a holding tank or a drag-out tank, pipe work connecting the tank to the said pump means and pipe work connecting the end of annular gap remote from the pump back to the tank.

The assembly is preferably a closed recirculating system. The pump is preferably located below or at the base of the reactor which is preferably disposed vertically or inclined upwardly in such a way as to economise on floor area occupied by the apparatus.

The base of the holding tank or a drag-out tank is preferably connected to the pump. The outlet from the top of the tubular array preferably feeds to the top of the holding tank.

More than one reactor tube may be used to increase capacity. Preferably such reactor tubes are arranged in series, e.g. 2, 3 or 4 since this only requires marginal increases in pumping power to overcome minor frictional constraints.

The reactors can be arranged in a serpentine path. Power supply controllers and pump and flow meter controls are desirably provided.

Deposit release means are desirably provided to enable the deposit which can be 0.3 to 0.7 mm or more, e.g. 1.5 to 2 mm thick to be readily separated from the cathode tube.

Non-conductive polymer strips have been found effective. These can be glued to the cathode surface, e.g. with epoxy resins. Alternatively they could be removably nested in slots in the cathode surface.

The deposit release means desirably also perform a spacer function ensuring that the cathode and anode are held apart and evenly spaced.

The invention also extends to a method of using an electroplating plant in which feedstock effluent from the plating plant is treated in apparatus in accordance with the present invention, metal used as an electrode in the electroplating plant is recovered at high purity and is re-used in the electroplating plant as electrode material without purification.

Figure 2:
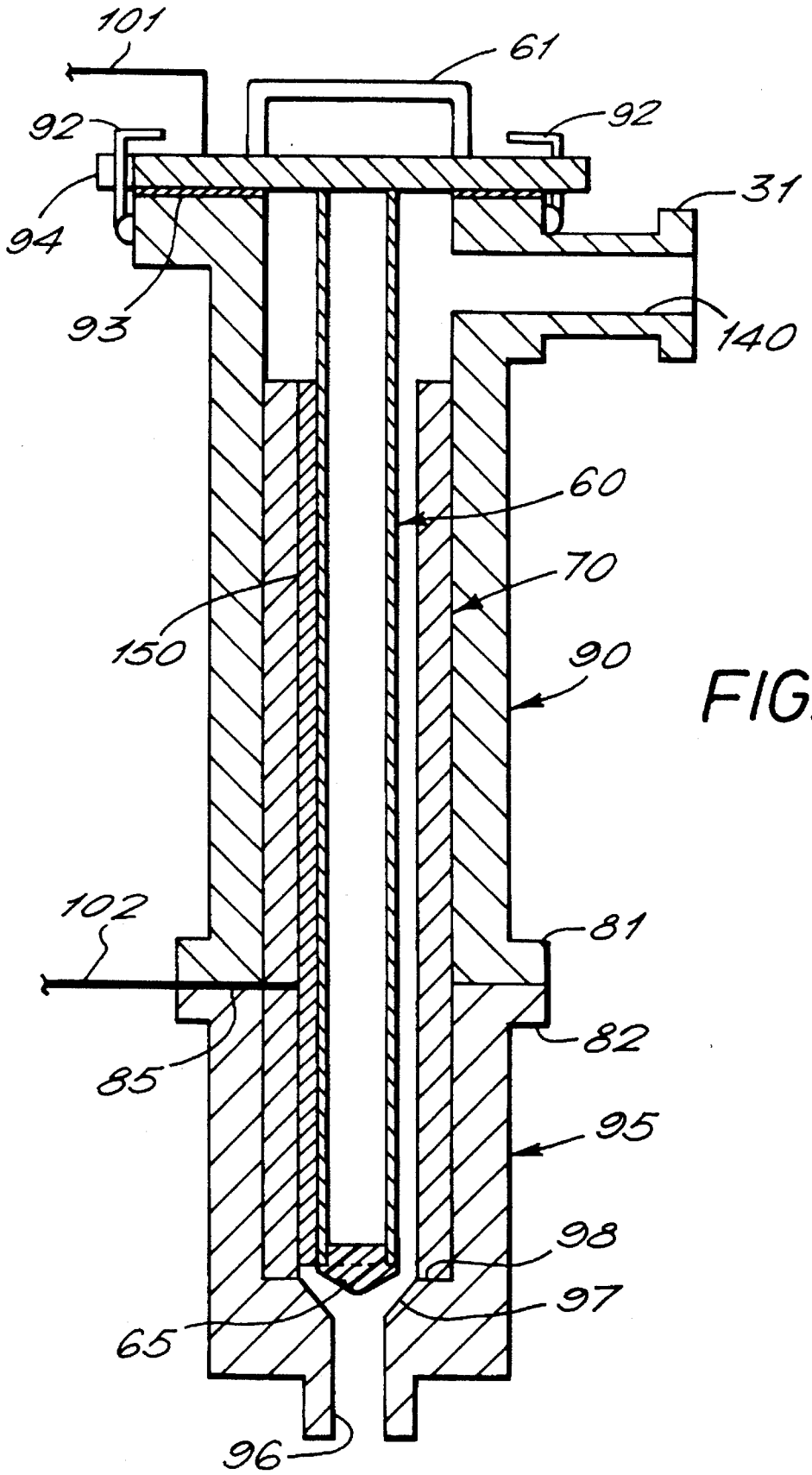
Figure 3:
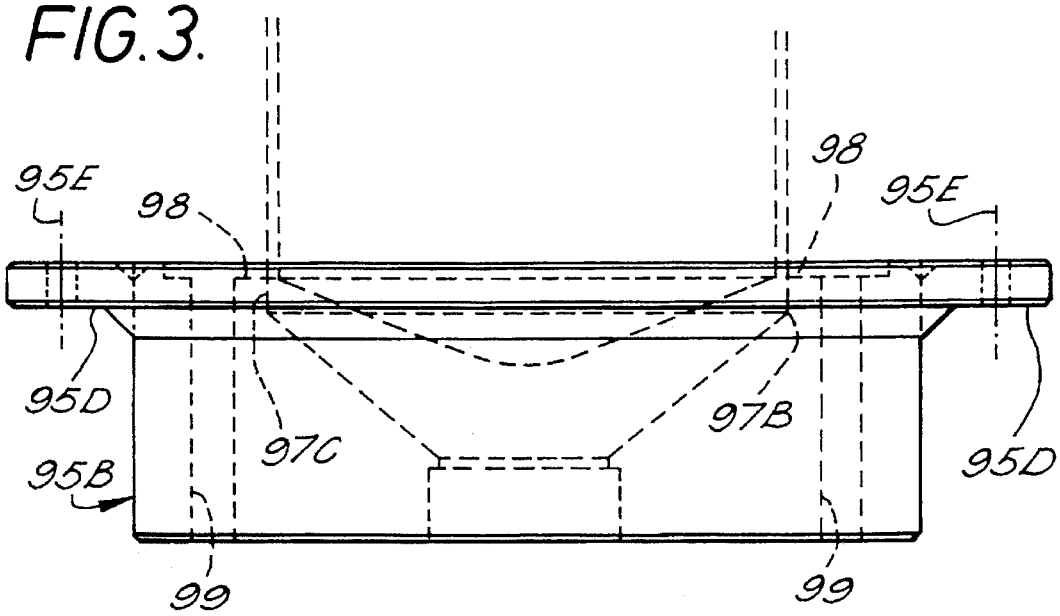
Figure 4:
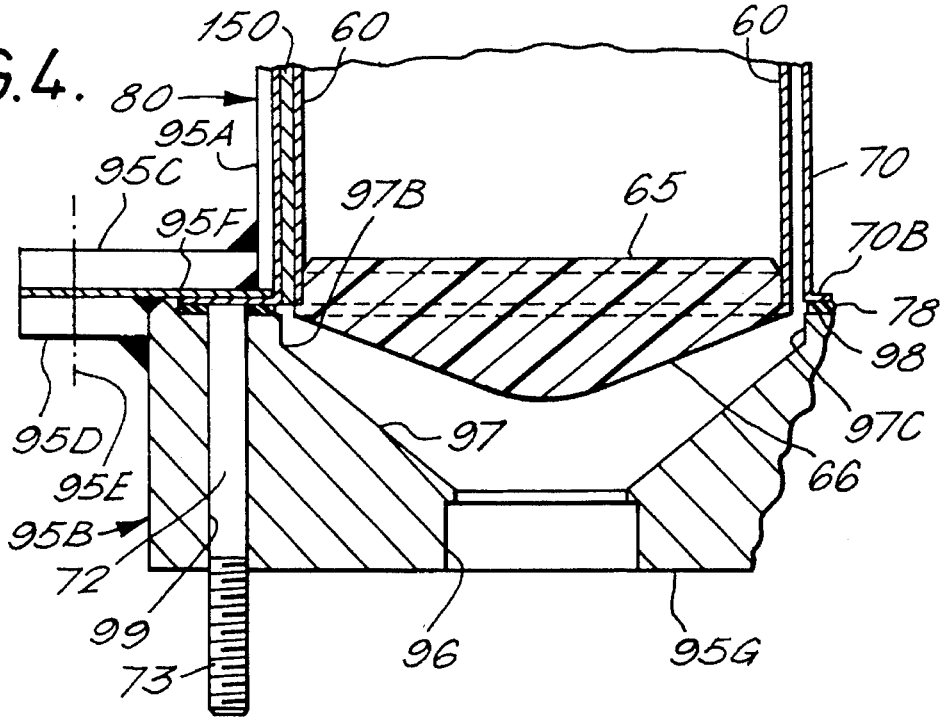
Figure 5:
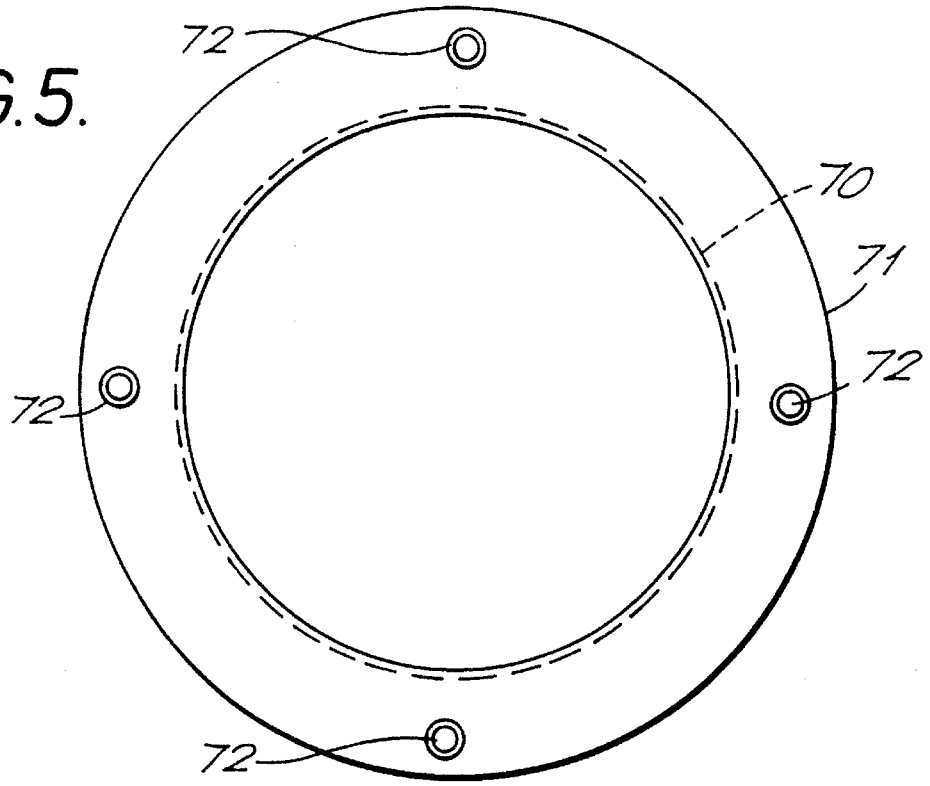
Figure 6:
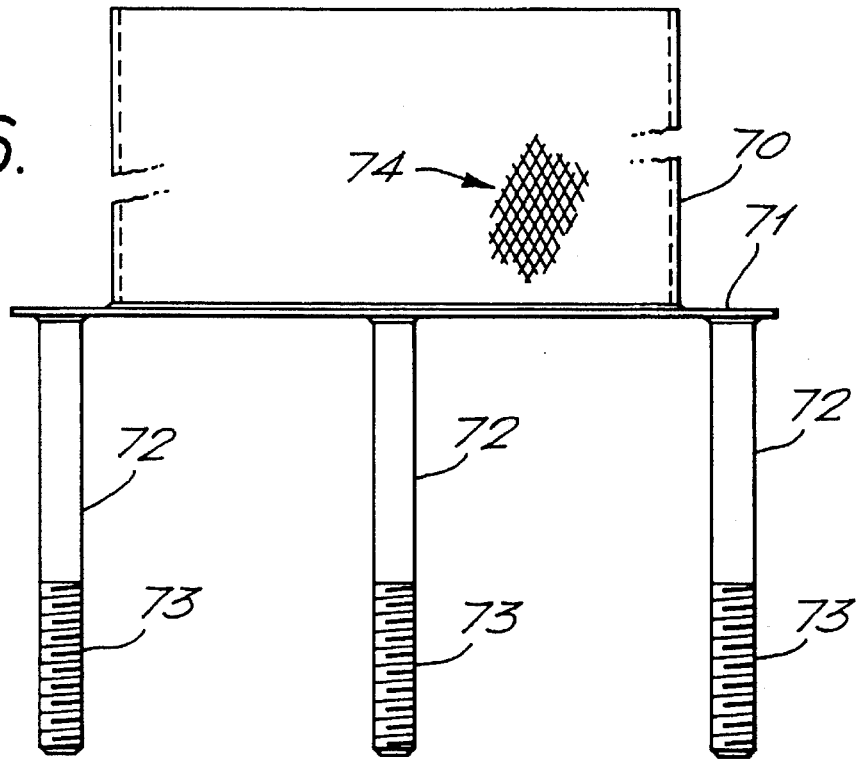

The invention may be put into practice in various ways and one specific embodiment will be described to illustrate the invention with reference to the accompanying drawings in which;

FIG. 1 is a diagrammatic general assembly view of apparatus in accordance with the present invention;

FIG. 2 is a detailed diagrammatic longitudinal section of a reactor suitable for use in the apparatus of FIG. 1, FIG. 3 is a side elevation on an enlarged scale of a preferred form of base for a reactor as shown in FIG. 2, showing in chain lines the components of the reactor, FIG. 4 is a consectional scrap elevation of the area of the base of the reactor as shown in FIG. 3 on the same scale, FIG. 5 is a plan view of the anode seen from the base end of the same scale as FIGS. 3 and 4, and FIG. 6 is a side elevation of the anode (reduced in length) showing the electrical connector studs on the same scale as FIG. 5.

Referring to, FIG. 1, the apparatus is mounted on a floor or staging 10. The apparatus has a holding tank 11 mounted on a stand 12 and connected via pipework 14 to a centrifugal recirculating pump 15. The outlet 16 from the pump passes via a valve 18 to the base of the reactor tube 20. The outlet 16 is connected via a valve 17 to a pressure indicator 19.

The reactor 20 is disposed substantially vertically and supported in appropriate staging (not shown). The top end of the reactor has an output pipe 30 connected via a flange 31 to pipework 32 which passes to the top of a pH control tank 40.

This required when a nickel containing feedstock is being used so that the pH can be held at about 4. For other metals suck as copper and zinc, pH control is not necessary and the tank 40 can be dispensed with. The pipe 32 can then be connected directly to the pipe 43.

The pH control tank has an internal baffle 42 and an outlet from its base passes via pipework 43 into the closed top of the holding tank 11. The pH control tank 40 is also closed but has a fume extractor outlet 45. It is provided with a pH meter 48 which controls a make-up pump 50 which supplies alkali, e.g. sodium hydroxide, from a sodium hydroxide holding tank 52 via a line 54 to the liquid reservoir 56 in the pH control tank 40.

The reactor 20 consists of a central removable cathode tube 60 which can be lifted by one man out of the top of the reactor 20 by a handle 61. The tube 60 is made of stainless steel of about 1.6 mm wall thickness and is about 1000 mm long and of 89 mm external diameter. At its top end it is welded to a flange 63 which is provided with four outwardly facing slots or notches 94 in its circumference. The lower end of the tube 60 is closed by a non-conductive rounded conical plug 65, e.g. of polypropylene, which is a force fit in the end of the tube (see FIGS. 2 and 4). The cathode tube 60 is located within an outer anode tube 70. As shown in FIGS. 2 and 4 one or more deposit release means or spacers 150 can be located between the cathode tube 60 and the anode tube 70. Besides ensuring release of the deposited metal foil or sheet such a spacer helps maintain an even gap dimension right round the circumference and for the full length of the anode.

One such spacer is shown here but 2, preferably 3 or more could be used.

The spacer 150 is 5 mm thick and about 10 mms wide and is secured by epoxy adhesive to the cathode surface. The metal deposits only slightly or not all on the nonconductive spacer which thus enables a lever, e.g. a knife blade to be inserted under the foil which can then be manually peeled away as a single self-supporting sheet, e.g. 300 microns or more thick. Thinner sheets may also be self-supporting and readily handled.

The anode tube 70 is itself located within an outer non-conductive polymer housing 80. The polymer housing 80 is formed in two parts 90 and 95, connected to each other by flanges 81 and 82. In the embodiment shown in FIG. 2 this flange can also be used to provide an inlet location for electric current supply to the anode as shown at 85. In this embodiment the anode is of graphite and since it has a tendency to porosity it is housed within the polymer housing 80. This housing can conveniently be of polypropylene. In this embodiment of FIG. 2 the housing 80 as mentioned above is in two parts 90 and 95. In this embodiment the lower part 95 has a central inlet duct 96 which flares outwardly at 97 in the region of the lower end of the cathode tube 60. The flaring region 97 terminates at 98 to form a radial step on which the lower end of the anode rests and by which it is supported. This step 98 is essentially opposite the metallic end of the cathode tube and the conical end 65 extends down into the flared region 97. The upper portion 90 of the housing 80 has an upper flange 91 which carries clamping levers 92 which fit within the slots 94 in the flange 63 of the reactor tube 60. This is more clearly shown in FIG. 2 and the arrangement is such as to enable the housing 90 to be forced up against the underside of the flange, compressing an appropriate chemically resistant ring 93 so as to provide a good seal. The flange 91 has at one side an outlet duct 140 which terminates in the flange 31 which as described above is connected to the pipe 32.

The cathode 60 is connected to a rectifier 100 via a line 101 affixed to the flange 63. The anode is connected to the rectifier 100 via a line 102 which is connected to the anode via the flanges 81 and 82 at the location 85 as described above.

A modified embodiment is shown in FIGS. 3 to 6 which has a different and preferred arrangement for the base of the reactor and the outer polymer housing 80 and has a modified means of current supply to the anode. However apart from these changes this second embodiment is the same as the first embodiment already described with reference to FIGS. 1 and 2.

Turning to FIGS. 3 and 4 of the housing 80 has its lower portion in two parts a cylindrical section 95A (see FIG. 4) and a base section 95B (see FIG. 3) both made of non conducting material e.g. polypropylene. The section 95A has an outwardly extending annular flange 96C which fits with a corresponding flange 95D on the base section 95B and to which it can be screwed e.g. by bolts (not shown) as at 95E, a gasket 95F preferably being located between the flanges 95C and 95D. The base section 95B has a central inlet duet 96 which flares outwardly at 9Y and straightens at 97B to form a rebate 97C before terminating at 98K to form a radial step on which the lower end 70B of the anode 70 rests. The rebate 97C ensures that even with the combination of manufacturing tolerances the slot will always be wider than the annular gaps. In this embodiment the anode 20 has an outwardly extending flange 71 at its lower end 70B. This is described in more detail below with reference to FIGS. 5 and 6.

A gasket 98 is located between the flange 70B and the radial step 78.

The reactor base 95B also has four axial holes 99 extending evenly around the central inlet duct 96. As shown in FIG. 4 these holes are for securing the anode.

Thus as can be seen in FIGS. 3, 4 and 5 the anode has a flange 71 at its lower end to which are secured four equally spaced connector studs 72 having threaded ends 73. The studs are welded to the flange 71 which in turn is welded to the anode, here made of mesh as denoted at 74.

As can be seen in FIG. 4 the studs 72 project through the holes 99 in the reactor base 95B and can be secured in place with bolts and washers (not shown) bearing against the underside 95G of the reactor base 95B. The studs are connected to the positive pole of the rectifer 100.

The wall 97 is disposed at an angle of between 30° and 60° to the longitudinal axis here about 50°. The end plug 65 whilst having a rounded end (which facilitates insertion of the plug into the cathode tube enabling a soft hammer to be used) could have a pointed conical end. The straight walls 66 of the conical plug are at an angle of about 70° to the longitudinal axis. The converging annular slot formed between the walls 97 and 66 thus encloses an angle of about 20° or more broadly 10° to 40°. The slot does not necessarily have to converge, the angle could be zero but the arrangement shown gives good results, resulting in even distribution of feedstock to the annular gap with minimum pressure loss.

The upper end 90 of the housing in this second embodiment is the same as is described for the first embodiment.

The whole system is under the control of a control panel 110 which has control links 112 and 113 to the rectifier 100 and 114 and 115 to the pump 15. The panel has an ammeter 120, a voltmeter 121, amperehour meter 122 and a temperature gauge 123. The ampherehour meter 122 is used to control the duration of the plating cycle. Depending on the metal involved and the efficiency achieved the weight of metal and thus deposit thickness produced in a given number of ampherehours can be calculated. The system is provided with an adjustable switch on the meter 122 which can be set to switch off the electrode current when a given number of ampherehours have been delivered. The temperature gauge may be arranged to sense temperature at any appropriate location in the system, either in the reactor, the holding tank or the pH control tank 40. The control panel 110 has a pump control switch 130 and warning light 131, a rectifier control switch 134 and a warning light 135 and a switch 137 and a control light 138 for the pH control dosing pump 50.

EXAMPLE 1

In a typical experiment carried out in the embodiment of FIG. 2 in which the feedstock was a copper electroplating solution containing 6.9 g/liter of copper ions the outer diameter of the reactor tube 60 was 89 mm, and the inner diameter of the graphite outer anode tube was 99 mm thus leaving an annular gap of 5 mm. The outer surface of the tube 60 had been polished to a satin finish. The inner surface of the graphite anode 70 was machined smooth. A flow rate of 12,000 liters/hour was used producing a flow velocity of 2000 mm/second (flow volume divided by cross-sectional area). A current of 84 ampheres was used, the cathode surface being 28 $dm^2$, this was a current density of 3 amps per square decimeter. The solution had a density of essentially 1 g/cc and a viscosity of essentially 0.7 cps.

The Re value under these conditions was 35,000.

The surface area of the cathode was 28 $dm^2$ (280000 sq/mm) and the volume of liquid located in the 5 mm gap at the commencement of plating was 0.7 liter. Thus the ratio of active cathode area in $dm^2$ to reactor volume in liters was 40:1.

The initial gap width radially (IGWR) is 5 mm initially whilst the gap length (GL) is 1000 mm. The ratio of GL/IGWR is thus 200:1. More broadly it is preferably in the range from 20:1 to 1000:1, more preferably 50:1 to 500:1, e.g. 100:1 to 400:1, especially 150:1 to 350:1.

A fine grained smooth continuous sheet of copper 900 micrometers (0.9 mm) of 99.9% purity was produced in twenty hours. The feedstock was 390 liters of acid electrolyte containing copper sulphate and hydrogen peroxide. The initial concentration of copper was 6.9 g/l, in four hours it had fallen to 5.8 g/l, in eight hours it had fallen to 4.6 g/l, in twelve hours to 3.6 g/l, in sixteen hours to 2.7 g/l and in twenty hours to 1.4 g/l.

The weight of copper deposited was 2145 g. The current density was 4A/$dm^2$. The theoretical deposit weight was 2609 g and thus the cathode efficiency was 82%.

EXAMPLE 2

A feedstock similar to that of Example 1 but without hydrogen peroxide and containing 1.2 g/l of copper ions was used again in the embodiment of FIG. 2.

The volume of electrolyte was 290 liters. A current density of 3.1A/$dm^2$ was used and a pump rate of 12,000 liters/hour. After 4 hours the copper concentration had fallen to 7 mg/l. The weight of copper deposited was 346 g. The theoretical deposit weight was 393 g and thus the cathode efficiency was 88%.

EXAMPLE 3

Example 1 was repeated in which the feedstock was a nickel electroplating solution containing 4.2 g/liter of nickel ions. A current of 100 ampheres was used, the cathode surface being 28 $dm^2$, this was a current density of 3.6 amps per square decimeter. The solution had a density of essentially 1 g/cc and a viscosity of essentially 0.7 cps.

The Re value under these conditions was 35,000.

A fine grained smooth continuous sheet of nickel 350 micrometers (0.35 mm) of 99.9% purity was produced in ten hours. The feedstock was 400 liters of acid electrolyte containing nickel sulphate and nickel chloride. The initial concentration of nickel was 4.2 g/l, in ten hours it had fallen to 3.1 g/l. The phi was controlled to be in the range 3.7 to 4.0 using the automatic pH dosing pump 50.

The weight of nickel deposited was 480 g. The current density was 3.6A/$dm^2$. The theoretical deposit weight was 968 g and thus the cathode efficiency was 50%.

EXAMPLE 4

Example 1 was repeated in which the feedstock was a cyanide zinc electroplating solution containing 5.2 g/liter of cyanide zinc ions. A current of 150 ampheres was used, the cathode surface being 28 $dm^2$, this was a current density of 5.4 amps per square decimeter. The solution had a density of essentially 1 g/cc and a viscosity of essentially 0.7 cps.

The Re value under these conditions was 35,000.

A fine grained smooth continuous sheet of zinc of 99.9% purity was produced in ten hours. The feedstock was 400 liters of cyanide electrolyte containing zinc oxide, sodium cyanide, and sodium hydroxide. The initial concentration of zinc was 5.2 g/l, in ten hours it had fallen to 3.0 g/l.

The weight oil zinc deposited was 890 g. The current density was 5.4A/$dm^2$. The theoretical deposit weight was 1790 g and thus the cathode efficiency was 50%.

EXAMPLE 5

Example 1 was repeated in which the feedstock was a silver electroplating solution containing 4.1 g/liter of silver ions. The outer diameter of the reactor tube 60 was 89 mm, and the inner diameter of the outer anode tube (which was also stainless steel) was 99 mm thus leaving an annular gap of 5 mm. The outer surface of the tube 60 had been polished to a satin finish. A flow rate of 12,000 liters/hour was used producing a flow velocity of 2000 mm/second (flow volume divided by cross-sectional area). A current of 56 ampheres was used, the cathode surface being 28 $dm^2$, this was a current density of 2 amps per square decimeter. The solution had a density of essentially 1 g/cc and a viscosity of essentially 0.7 cps.

The Re value under these conditions was 35,000.

A fine grained smooth continuous sheet of silver was produced in 3.75 hours. The feedstock was 200 liters of cyanide electrolyte containing silver potassium cyanide and potassium cyanide. The initial concentration of silver was 4.1 g/l, in 3.75 hours it had fallen to 4 ppm.

The weight of silver deposited was 819 g. The current density was 2A/$dm^2$. The theoretical deposit weight was 853 g and thus the cathode efficiency was 96%.

EXAMPLE 6

Example 1 was repeated in which the feedstock was a gold electroplating solution containing 1.24 g/liter of gold ions. The outer diameter of the reactor tube 60 was 89 mm, and the inner diameter of the outer anode tube (which was titanium) was 99 mm thus leaving an annular gap of 5 mm. The outer surface of the tube 60 had been polished to a satin finish. A flow rate of 12,000 liters/hour was used producing a flow velocity of 2000 mm/second (flow volume divided by cross-sectional area). A current of 56 ampheres was used, the cathode surface being 28 $dm^2$, this was a current density of 2 amps per square decimeter. The solution had a density of essentially 1 g/cc and a viscosity of essentially 0.7 cps.

The Re value under these conditions was 35,000.

A fine grained smooth continuous sheet of gold 46 micrometers thick was produced in four hours. The feedstock was 200 liters of acid gold electrolyte containing gold potassium cyanide. The initial concentration of gold was 1.24 g/l, in four hours it had fallen to 6 mg/l, (6 ppm). The weight of gold deposited was 247 g. The current density was $2A/dm^2$. The theoretical deposit weight was 1648 g and thus the cathode efficiency was 15% (which is a good figure for gold).

The process of the present invention is applicable widely to recovery of metals from electroplating solutions and other metal ion solutions, though some may require pH control by addition of acid or base as indicated above.

Systems in which the metal values are complexed may be recoverable by dosing with materials effective to break the complex and release metal ions.

It will be appreciated that a series system consisting of two sets of apparatus as shown in FIG. 1 could be used. So that in a first step the metal content would be lowered to say 1 g/l and in a second step that material would be used as a feedstock to produce a more dilute solution, e.g. as for Example 1 down to ppm levels.

Possibly the first stage could have two or more holding tanks 11. Thus a first tank would be circulated through the reactor first. It could then be connected to the second reactor whilst the second tank could then be circulated through the first reactor.

We claim:

1. A method of removing metal from a feedstock solution containing dissolved metal ions which comprises passing the feedstock through an annular gap formed by an inner cathode tube and an outer anode tube at a flow rate which is turbulent and which, in conjunction with the cross section of the gap, provides Re value (as defined herein) of the flow of at least 2100, the inner surface of the gap being cathodic to the metal ions in the solution and formed of a metal which is smooth and is not attacked by the solution, the outer surface of the gap being smooth and anodic to the metal ions in the solution, inducting the solution flow into the annular gap by means of a pump coupled directly to the gap, the end of the inner cathode tube being closed by a non-conductive domed plug which faces the incoming flow of solution and distributes it evenly to the annular gap and depositing the metal ions in the feedstock solution on the cathodic surface.

2. A method as claimed in claim 1 in which the cathode is provided with at least one non-conductive region extending along at least part of its length such that metal deposited on the cathode has a weakness region formed in it at the said non-conductive regions such as to facilitate removal of the deposited metal as sheet from the cathode surface.

3. Apparatus for removing metal from a feedstock containing dissolved metal ions which comprises a reactor formed by an inner cathode tube and an outer anode tube spaced therefrom by a narrow annular gap, direct electric current supply means to the anode and cathode to effect deposition on the cathode of the metal in the feedstock, pump means for pumping feedstock into the said annular gap at high flow rates, said pump means feeding the feedstock to the annular gap from a pump outlet via an annular slot axially disposed relative to the gap, a holding tank, pipe work connecting the holding tank to the pump means and pipe work connecting the end of the annular gap removed from the pump to the holding tank.

4. Apparatus as claimed in claim 3 in which the annular slot is converging from the pump outlet to the gap.

5. Apparatus as claimed in claim 4 in which the converging annular slot encloses an angle of 10° to 40°.

6. Apparatus as claimed in claim 3, in which the reactor is formed with an impervious housing having a base, an axial outlet duct from the pump and a cylindrical housing enclosing the anode and cathode.

7. Apparatus as claimed in claim 6 in which the housing has an outlet cap, an output duct from the gap and securing means for securing the cathode in place and sealing the upper end of the reactor.

8. Apparatus as chimed in claim 7 in which the lower end of the cathode tube is closed by a conical plug.

9. Apparatus as claimed in claim 8 in which the base is formed with a diverging wall extending out from the outlet duct to the gap and this wall with the conical plug defines the annular slot by which the feedstock is led from the outlet duct to the annular gap.

10. Apparatus as claimed it claim 9 in which the anode is provided with at least one axially disposed connector stud and the base of the housing affords at least one cooperating axial hole for the said stud, the stud being of a length such as to extend through the said hole to provide a connector location for supply of current to the anode.

11. Apparatus as claimed in claim 10 in which the anode has an outwardly extending flange at one end to which at least two connector studs are conductively secured at evenly spaced locations round the flange.

12. Apparatus as claimed in claim 3 in which deposit release means are provided to enable the deposit to be readily separated from the cathode tube.

13. Apparatus as claimed in claim 12 in which the deposit release means are dimensioned so as to perform a spacer function ensuring that the cathode and anode are held apart and evenly spaced.

* * * * *